US006997352B2

(12) United States Patent
Sallows et al.

(10) Patent No.: US 6,997,352 B2
(45) Date of Patent: Feb. 14, 2006

(54) LIQUID DISPENSER ASSEMBLY

(75) Inventors: Geoffrey Sallows, Seaford (GB); Etienne Vincent Bunoz, Eastbourne (GB)

(73) Assignee: Brightwell Dispensers Limited, (GB)

( * ) Notice: Subject to any disclaimer, the term of this patent is extended or adjusted under 35 U.S.C. 154(b) by 152 days.

(21) Appl. No.: 10/380,265

(22) PCT Filed: Sep. 14, 2001

(86) PCT No.: PCT/GB01/04109

§ 371 (c)(1),
(2), (4) Date: Mar. 12, 2003

(87) PCT Pub. No.: WO02/22449

PCT Pub. Date: Mar. 21, 2002

(65) Prior Publication Data

US 2004/0094574 A1 May 20, 2004

(30) Foreign Application Priority Data

Sep. 15, 2000 (GB) ..... 0022685

(51) Int. Cl.
*B65D 35/56* (2006.01)

(52) U.S. Cl. ..... 222/105; 222/505; 222/509; 141/114

(58) Field of Classification Search ..... 222/92, 222/100, 95, 105–107, 505, 509, 481.5; 141/114; 251/339

See application file for complete search history.

(56) References Cited

U.S. PATENT DOCUMENTS

| | | | | |
|---|---|---|---|---|
| 4,363,338 | A * | 12/1982 | Brown | 141/2 |
| 4,421,146 | A * | 12/1983 | Bond et al. | 141/349 |
| 5,095,962 | A * | 3/1992 | Lloyd-Davies et al. | 141/346 |
| 5,556,005 | A * | 9/1996 | Banks | 222/96 |
| 5,645,194 | A * | 7/1997 | Tyner | 222/147 |
| 5,797,524 | A * | 8/1998 | Lentz | 222/505 |
| 5,878,915 | A * | 3/1999 | Gordon et al. | 222/82 |
| 5,901,761 | A * | 5/1999 | Rutter et al. | 141/346 |

FOREIGN PATENT DOCUMENTS

| | | | |
|---|---|---|---|
| EP | 0324257 A2 | * | 7/1989 |
| GB | 9910468.9 | | 5/1999 |
| GB | 2 349 921 A | | 4/2000 |

* cited by examiner

*Primary Examiner*—Frederick Nicolas
(74) *Attorney, Agent, or Firm*—Diller, Ramik & Wight

(57) ABSTRACT

A liquid dispenser has a support (2) for a collapsible container (28) and a connector (60), including a stopper (8), to connect an actuator of the liquid dispenser to the collapsible container (28). The stopper (8) is movable from a first position to a second position in which the stopper (8) connects to the collapsible container (28), whereby operation of the actuator causes the delivery of liquid from the dispenser. The collapsible container (28) is a flexible pouch (38) having a valve (52) which, upon movement of the stopper (8) into its second position, is moved from a first position preventing loss of liquid from the pouch (38), into a second position in which the stop valve (52) allows the delivery of a quantity of liquid from the dispenser.

23 Claims, 8 Drawing Sheets

LIQUID DISPENSER ASSEMBLY

BACKGROUND OF THE INVENTION

This invention is concerned with improvements in or relating to liquid dispensers and collapsible containers for use in such dispensers.

Dispensers for dispensing liquid soaps, detergents and the like usually use collapsible containers, viz. pouches of plastic material, which pouches are supplied as throw away products which are disposed of when the contents thereof have been exhausted.

A major disadvantage of a pouch made from a flexible plastic material, or the like, is the inherent tendency of the pouch to collapse as the contents thereof are depleted, the pouch undergoing the phenomenon of self sealing.

This is an irritating and costly occurrence which interferes with the operation of the dispenser and leads to extra maintenance of the dispenser unit in order to correct the malfunction by, either inverting the pouch to release the contents thereof or by replacing the self sealed pouch.

In either case there is a loss to the supplier of the dispenser, not only by way of added costs, but also by way of loss of goodwill from a dissatisfied customer.

The present invention seeks to overcome, or at least mitigate, the drawbacks of currently available dispensers and pouches for use therewith.

SUMMARY OF THE INVENTION

Thus the present invention conveniently provides a liquid dispenser comprising an actuator, operation of which actuator, when the dispenser is in use and a supply of liquid is provided in the dispenser, delivers a quantity of the liquid, the dispenser comprising support means for a collapsible container, connector means for connecting the actuator to a collapsible container supported by the support means, characterised in that the connector means is mounted for movement between a first position adjacent the support means and a second position in which the connector means connects with a collapsible container supported by the support means, when the dispenser is in use, to facilitate the delivery of liquid from the dispenser upon operation of the actuator.

Preferably the connector means is mounted on a carrier supported by the support means for movement between its first and second positions.

More preferably the carrier is pivotally mounted on the support means.

The connector means conveniently comprises a stopper pivotally mounted on the carrier means.

Preferably the collapsible container is a pouch of flexible material, for example, a plastic material.

In one preferred embodiment of the invention the pouch includes a port, adapted in use, to be engaged by the stopper of the connector means for facilitating the delivery of a quantity of liquid upon the operation of the actuator.

Conveniently, the pouch includes a stop valve located in the port, the stop valve being adapted, in use, to prevent the loss of liquid from the pouch until the pouch is located within the dispenser and the connector means is moved to its second position, in which second position the stop valve is engaged by the stopper of the connecting means, whereupon the stop valve is moved from a first position, in which the stop valve prevents loss of liquid from the pouch, to a second position in which the stop valve facilitates the delivery of a quantity of liquid upon the operation of the actuator.

Preferably, the stop valve comprises a seal portion, which is a push-fit within the port, the stop valve also comprising a vent portion outwardly adjacent said seal portion for facilitating delivery of a liquid from the pouch when the dispenser is in use and the stop valve is moved to its second position.

The stop valve also conveniently comprises an elongate portion which extends within the pouch to provide means whereby the pouch cannot self seal until all, or substantially all, of the liquid is removed therefrom.

Preferably the vent portion of the stop valve is cruciform in cross-section. The elongate portion of the stop valve is also conveniently of cruciform cross-section.

The present invention also conveniently provides a collapsible container for use in a liquid dispenser characterised in that the container is provided by a pouch of flexible material having a port and a stop valve located in the port and being adapted, in use, to prevent the loss of liquid from the pouch.

The stop valve further conveniently comprises a seal portion, which seal portion is a push-fit within the port, the stop valve also comprising a vent portion outwardly adjacent the seal portion for facilitating delivery of a liquid from the pouch.

Preferably, the stop valve also comprises an elongate portion which extends within the pouch to provide means whereby the pouch cannot self-seal until all, or substantially all, of the liquid is removed therefrom.

Conveniently, the vent portion of the stop valve is of cruciform cross-section. Also, the elongate portion of the stop valve is preferably of cruciform cross-section.

The present invention also provides a liquid dispenser assembly characterised by the combination of a liquid dispenser according to the first ten of the last fourteen preceding paragraphs and a collapsible container according to the last four of the preceding paragraphs.

There now follows, by way of example of the present invention, a detailed description of a dispenser and a collapsible container for use therewith, which description is to be read with reference to the accompanying drawings in which:

BRIEF DESCRIPTION OF THE DRAWINGS

FIG. 9 is an upper right hand segmental perspective view corresponding to FIGS. 6, 7 and 8; and, FIG. 10 is an upper perspective fragmental view of a stop valve of the collapsible container.

DESCRIPTION OF THE PREFERRED EMBODIMENTS

Difficulties have been met when using dispensers provided with liquid soap, detergents and the like products in collapsible containers, viz. pouches of flexible plastic material. These difficulties have been caused by the tendency of the pouches to self-seal as the contents thereof are depleted leaving a proportion of the contents in the pouch.

The dispenser assembly of the present invention obviates the drawbacks of prior arrangements and comprises a dispenser as disclosed in our co-pending Patent Application No. GB 9910468.4, details of which are imported herein by reference only.

Figure 1:
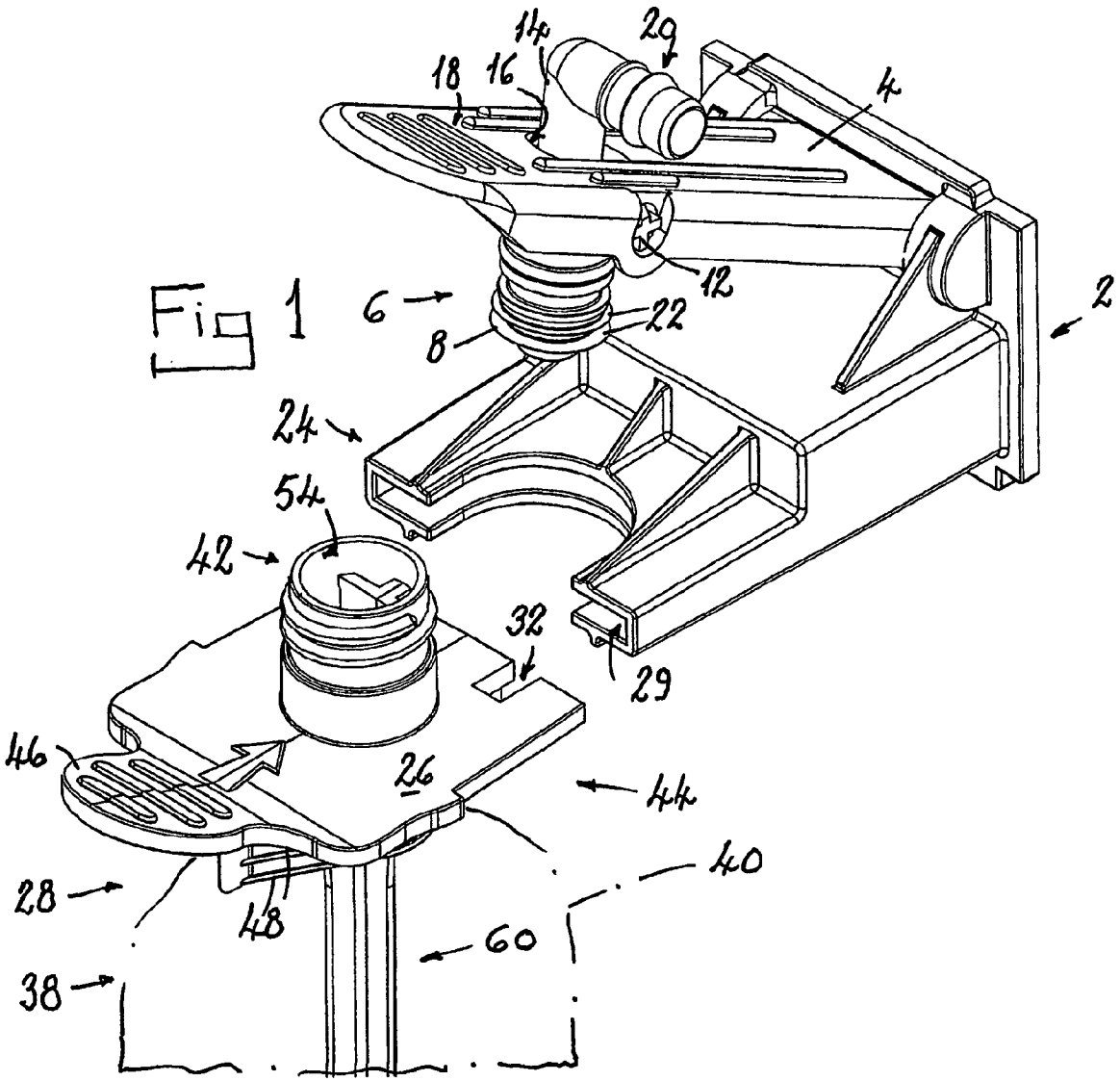
FIG. 1 is an upper right hand segmental perspective view of parts of a dispenser and a collapsible container for use therewith.
Figure 2:
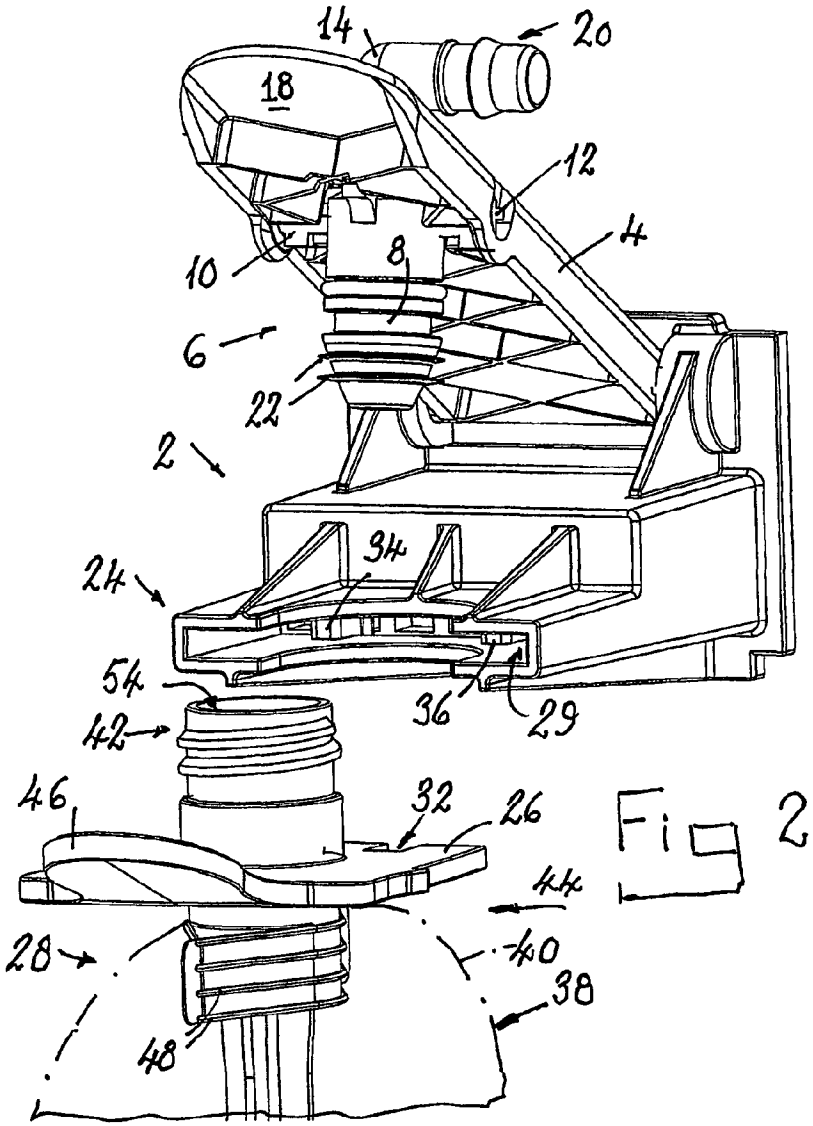
FIG. 2 is a right hand side perspective view generally from the front of the parts shown in FIG. 1.

The dispenser assembly includes a housing, not shown, on which is fixedly secured a support bracket 2, which bracket 2 provides pivotal support for a carrier 4, see FIGS. 1 and 2.

The carrier 4 provides support for a connector means 6 for a purpose to be described herein. As shown in FIGS. 1 and 2, the connector means 6 comprises a stopper 8 which extends below the carrier 4 and is pivotally mounted on the carrier 4 by sideways extending fulcrum arms 10 and 12.

An upper portion 14 of the stopper extends through an aperture 16 formed in a wall 18 of the carrier 4 where it is connected by a tubular pipette 20 to a delivery pipe of the dispenser.

The stopper 8 is tubular in cross-section and is provided with peripheral sealing fins 22 and an "O" ring seal 23 for a purpose to be described herein.

Figure 4:
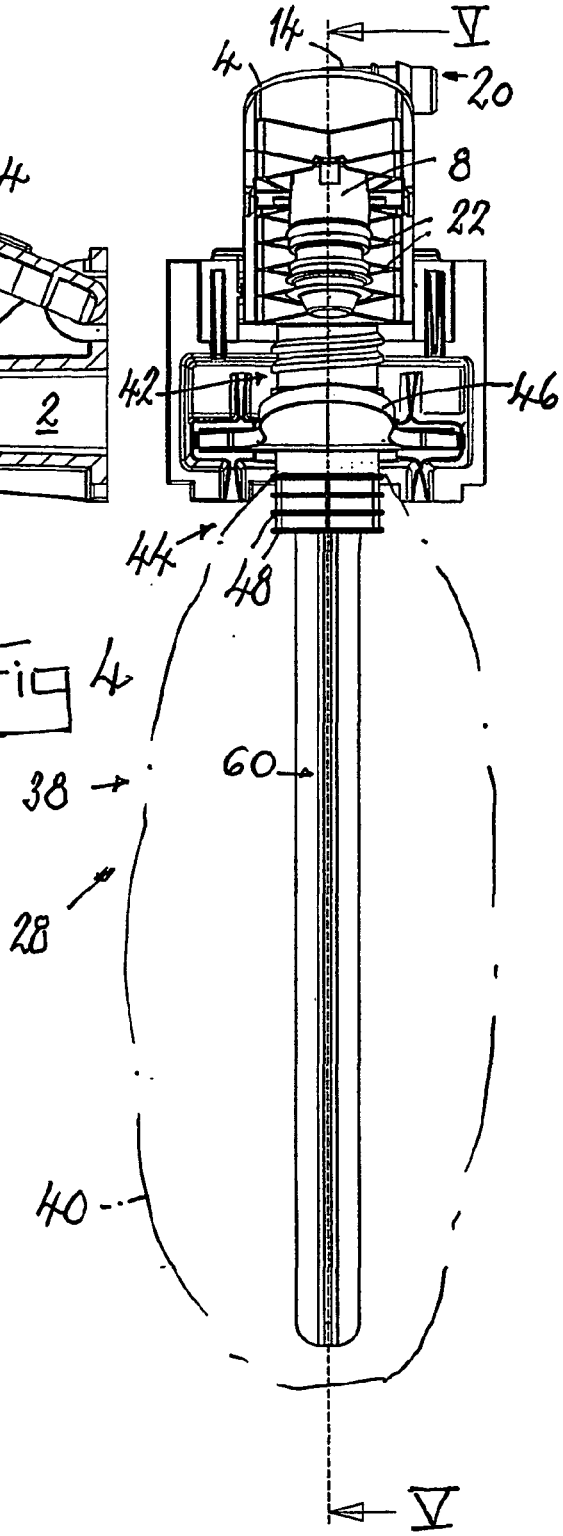
FIG. 4 is a front view corresponding to FIG. 3.
Figure 6:
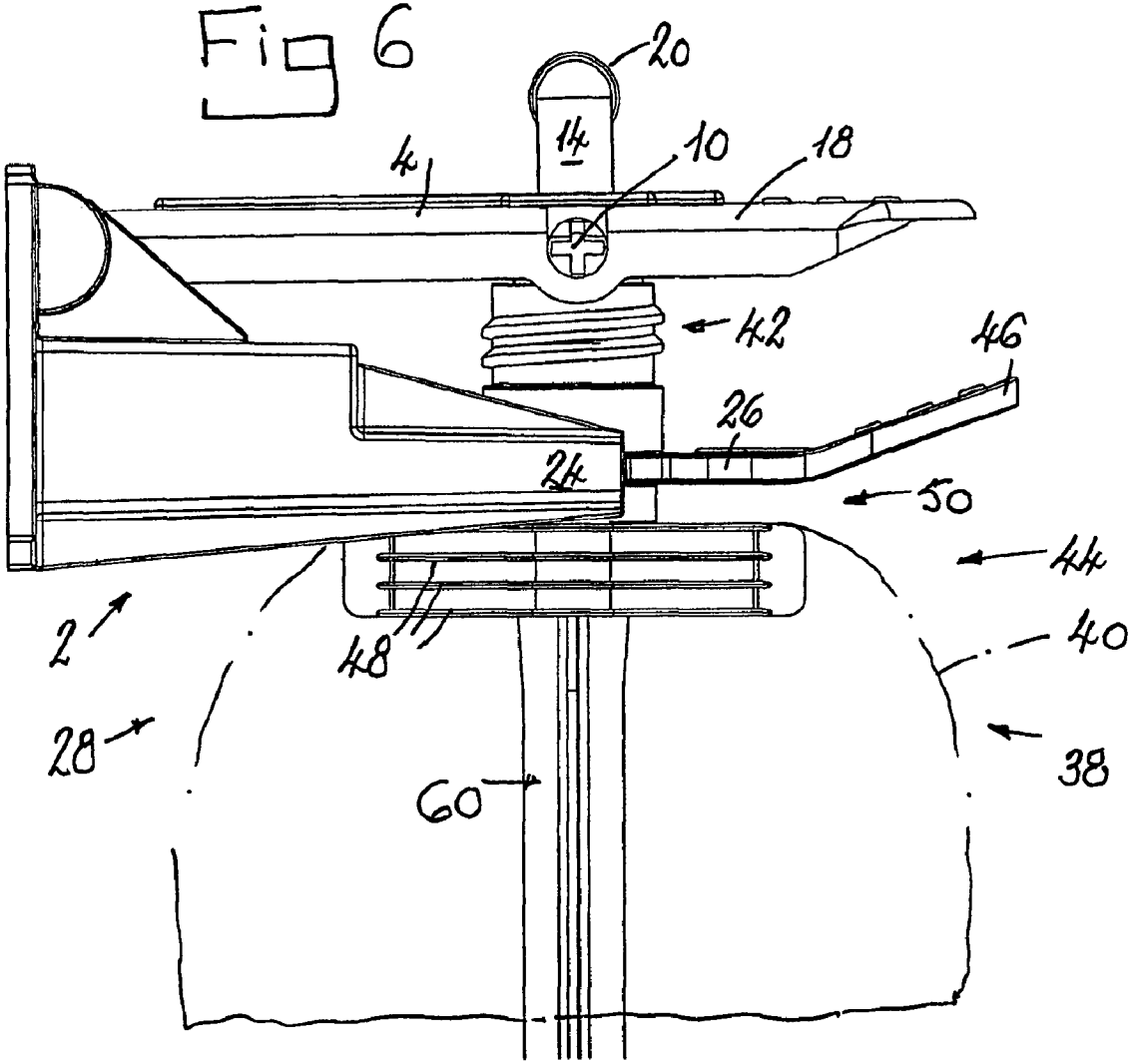
FIG. 6 is a fragmental side view corresponding to FIG. 3 but showing connecting means of the dispenser in engagement with the collapsible container.

The support bracket 2 is configured at a forward end portion 24 to receive a flange 26 of a collapsible container 28, see FIG. 4, when the dispenser is in use.

The flange 26 is a slide fit in a correspondingly shaped aperture 29 of the bracket 2. A forward end of the flange 26 is provided with slots 30 and 32 which, when the flange 26 is inserted into the aperture 28 are engaged by keying pins 34 and 36, see FIG. 2.

The collapsible container 28 comprises a pouch 38 of a flexible plastic membrane 40 with a tubular port 42 being provided towards an upper end portion 44 thereof, see FIG. 4.

The tubular port 42 has the flange 26 co-moulded thereon, which flange 26 extends forwardly, viewing FIG. 1, to provide a handle 46 by which the pouch 38 may be carried as it is mounted into the dispenser.

Figure 3:
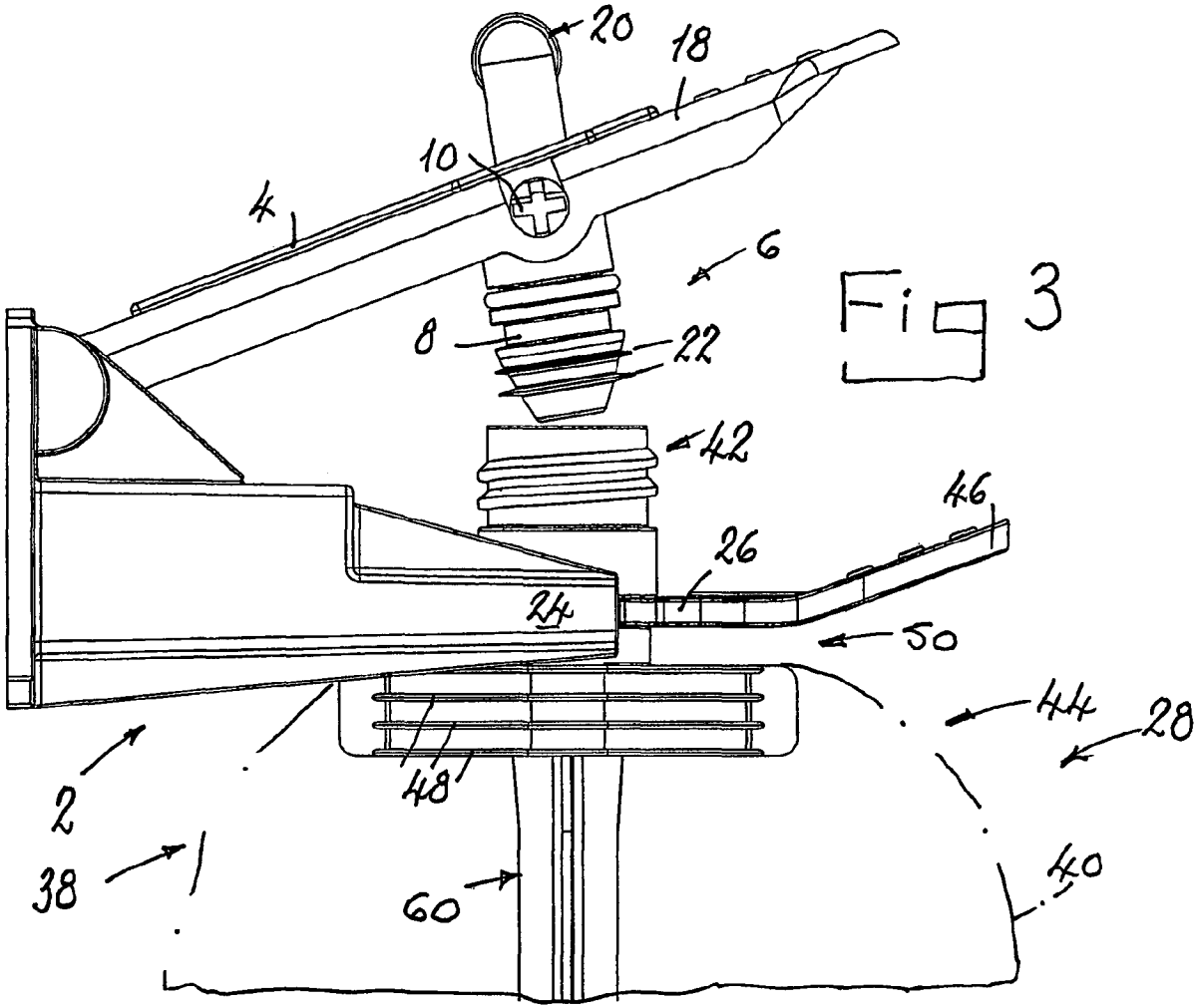
FIG. 3 is a fragmental side view of the parts shown in FIG. 1 with the collapsible container supported in the dispenser.

The tubular port 42 also has conventional pouch sealing fins 48 co-moulded therewith at a lower end portion 50 thereof, see FIGS. 3 and 4.

The collapsible container also comprises a stop valve 52, which valve 52 is located in and is a push-fit in a length-wise bore 54 of the tubular port 42.

Figure 5:
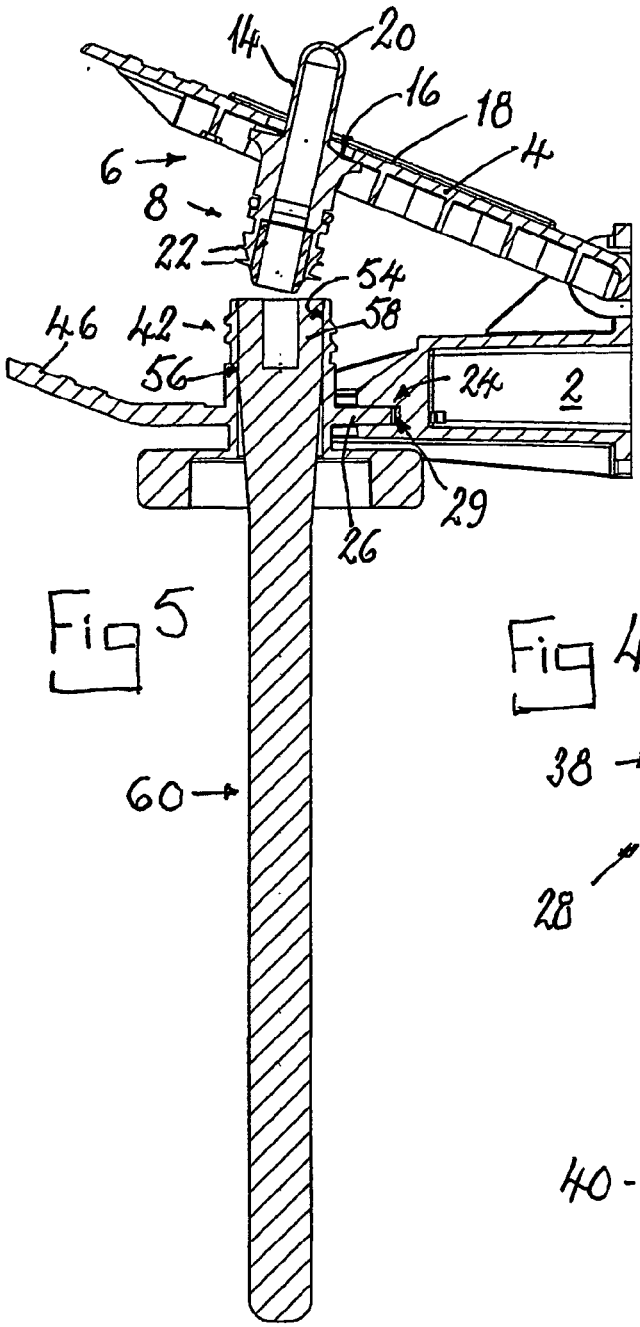
FIG. 5 is a section view taken along the line V—V of FIG. 4.
Figure 8:
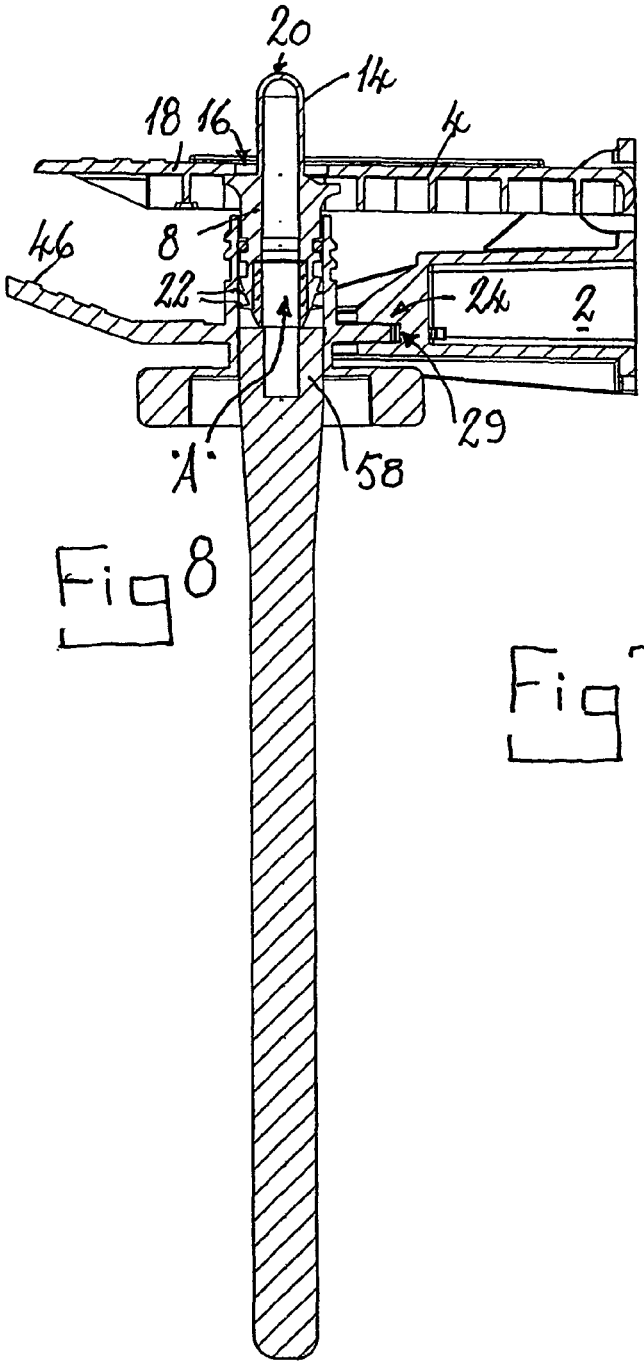
FIG. 8 is a section view taken along the line VIII—VIII of FIG. 7.
Figure 7:
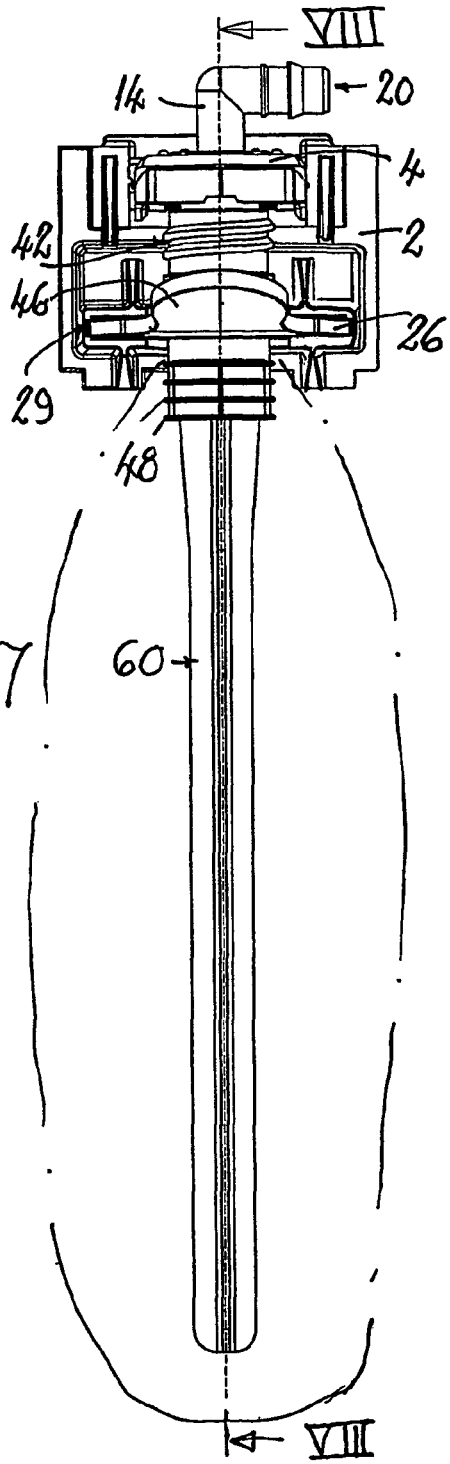
FIG. 7 is a front view corresponding to FIG. 6.
Figure 6:
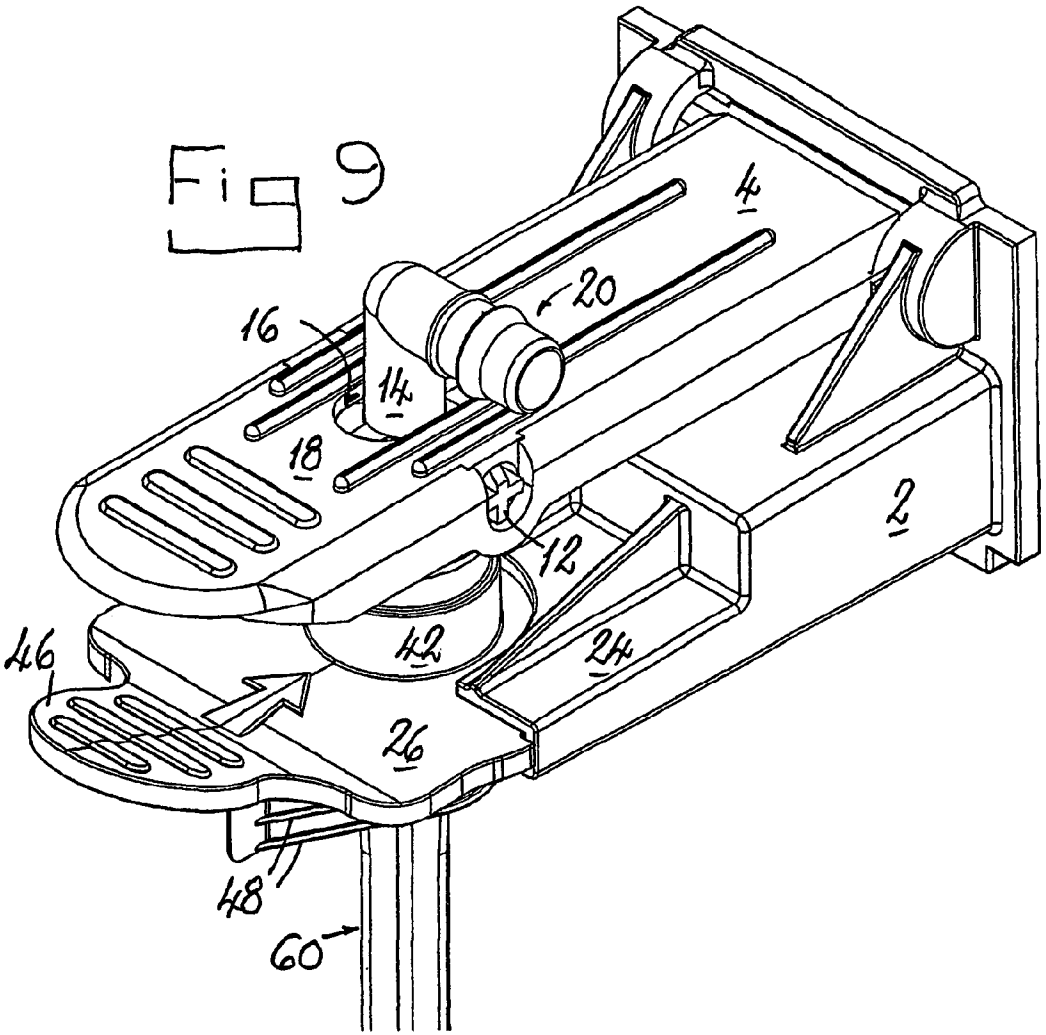
Figure 10:
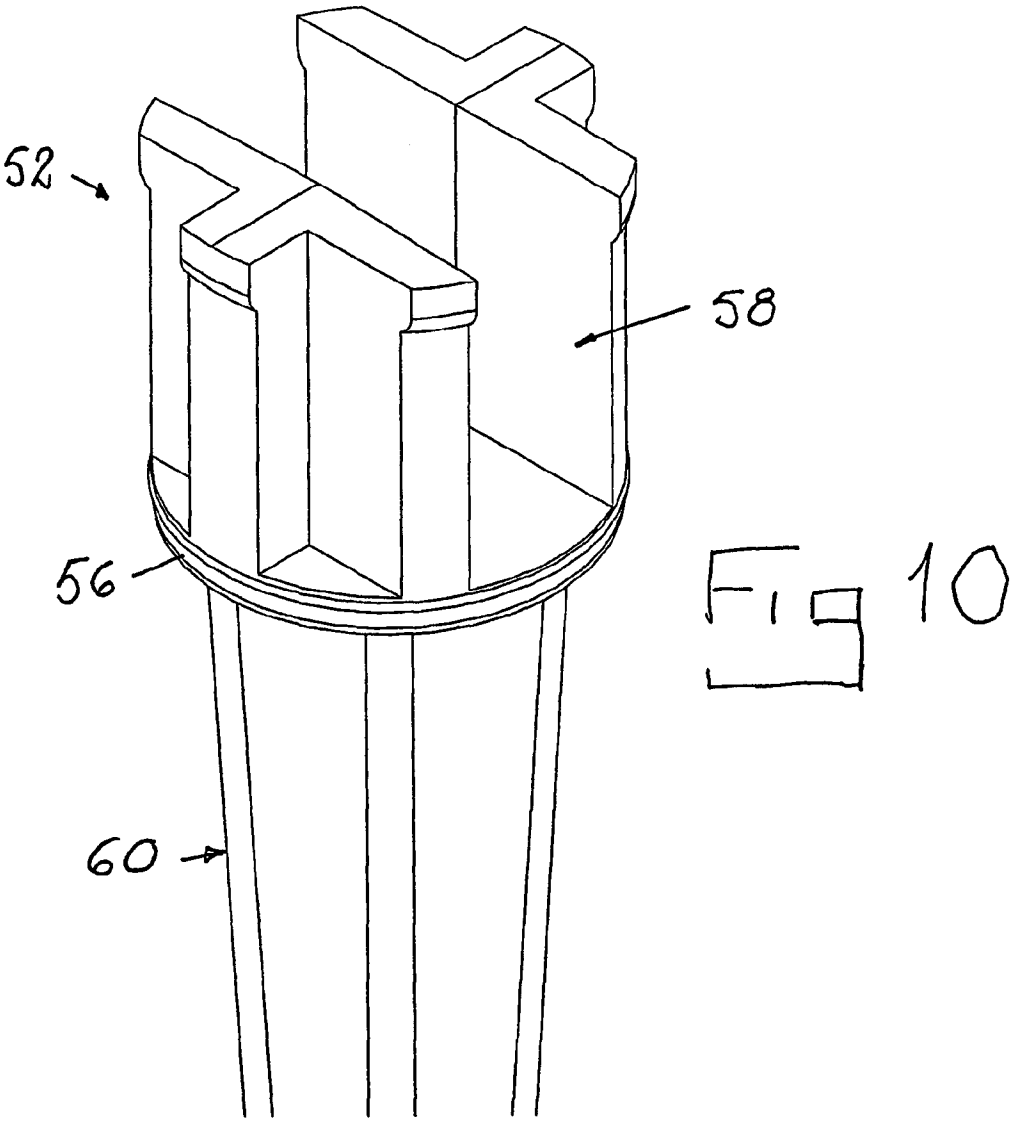

The stop valve 52 is of elongate form and comprises a peripheral seal portion 56, a vent portion 58 of cruciform cross-section outwardly adjacent the seal portion 56, see FIGS. 5, 8 and 10.

The stop valve 52 further comprises a depending elongate portion 60 of cruciform cross-section the purpose of which will become clear hereinafter.

When commissioning a dispenser for the first time or replacing a depleted pouch 38, having removed the depleted pouch 38, an operative grasps a new pouch 38 of liquid by it's handle 46 and offers the flange 26 thereof up to the aperture 29 of the support bracket 2.

The flange 26 is pressed home until the slots 30 and 32 thereof are engaged by their respective pins 34 and 36. At this time the tubular port 42 is located below the stopper 8 of the connector means 6. The operative next moves the stopper 8 downwards from a first position as shown in FIGS. 3, 4 and 5 into a second position as shown in FIGS. 6, 7, 8 and 9, the carrier 4 pivoting about its mounting and the stopper 8 pivoting on its fulcrum arms 10 and 12.

As the stopper 8 approaches its second position it enters into the bore 54 of the tubular port 42 where it engages an upper end 62 of the stop valve 52, which stop valve 52 is pushed downwards until it reaches the position shown in FIG. 8.

At this time, the peripheral sealing fins 22 and the "O" ring seal 23 engage the inside wall of the tubular port 42 to form a fluid tight seal therewith. The downward displacement of the stop valve 52 causes the seal portion 56 to be moved below the tubular port 42 out of engagement with the inside wall thereof. In this way a path "A" is opened between the pouch 38 and the connecting means, see FIG. 8, thereby facilitating the delivery of a quantity of liquid from the pouch 38 upon operation of the actuator.

It will be appreciated that the cruciform cross-section of the vent portion of the stop valve 52 provides part of the path "A".

It will further be appreciated that the cruciform cross-section of the elongate portion 60 of the stop valve facilitates the depletion of the contents of the pouch 38. This is achieved because a continuous path is provided, from the bottom of the pouch to the vent portion 58 of the stop valve 52, even when the flexible wall of the pouch 38 collapses inwards.

Although not described herein in detail, it will be evident that the plastic material for the pouch may be that which is suitable for purpose and the choice may depend upon the liquid to be contained therein.

It will be obvious that the pouches are supplied with a cap, not shown, which cap is preferably of the screw cap type, which is removed before placing a pouch in the dispenser.

In order to prevent the liquid in the stopper 8 from dripping when replacing a depleted pouch with a new one, the tubular stopper 8 is provided with a gauze membrane 62 extending across the inside thereof, see FIG. 5.

Although a preferred embodiment of the invention has been specifically illustrated and described herein, it is to be understood that minor variations may be made in the apparatus without departing from the spirit and scope of the invention, as defined by the appended claims.

What is claimed is:

1. A collapsible container for use in a liquid dispenser comprising a collapsible pouch of flexible material having a port and a stop valve located in the port, the stop valve having a first position in which the stop valve prevents loss from the pouch of liquid carried in the pouch and a second position in which the stop valve facilitates the delivery from the pouch of the liquid carried therein, the stop valve including an elongate portion which extends within the pouch, and the elongated portion includes means for preventing the pouch from self-sealing until substantially all the liquid housed in the pouch is removed.

2. The collapsible container as defined in claim 1 wherein the stop valve includes a seal portion push-fit with the port such that in the first position the seal portion is in engagement with an inside wall of the port, and in the second position the seal portion is pushed out of engagement with the port and into the pouch.

3. The collapsible container as claimed in claim 2 wherein the stop valve includes a vent portion which extends outwardly from said seal portion in which in the second position the vent portion remains in the port and facilitates the delivery of the liquid from the pouch.

4. The collapsible container as defined in claim 3 wherein the vent portion is cruciform cross-section.

5. The collapsible container as defined in claim 2 wherein the elongate portion is cruciform in cross-section.

6. The collapsible container as defined in claim 3 wherein the elongate portion is cruciform in cross-section.

7. The collapsible container as defined in claim 1 wherein the flexible material is plastic material.

8. The collapsible container as defined in claim 1 in which the post has a flange which is provided with a handle by which the pouch may be carried.

9. A liquid dispenser assembly comprising a liquid dispenser and a collapsible container, the collapsible container including a pouch of flexible material having a port and a stop valve located in the port, the stop valve having a first position in which the stop valve prevents loss from the pouch of liquid carried therein, a second position in which the stop valve facilitates the delivery from the pouch of the liquid carried therein, the stop valve including an elongate portion which extends within the pouch, the elongated portion includes means for preventing the pouch from self-sealing until substantially all the liquid housed in the pouch is removed, the liquid dispenser including support means for supporting the collapsible container and connector means for connecting the collapsible container to the dispenser, and the connector means being constructed and arranged to push the stop valve to the stop valve second position to facilitate the delivery of the liquid from the pouch.

10. The liquid dispenser assembly as defined in claim 9 wherein the liquid dispenser includes an actuator, said actuator being operative to deliver a quantity of the liquid from the dispenser, and said connector means being mounted for movement between a first position spaced apart from the support means and a second position in which the connector means connects with the collapsible container when the connector means is supported by the support means in use thereby to facilitate the supply of the liquid from the collapsible container to the dispenser for delivery upon operation of the actuator.

11. The liquid dispenser assembly as defined in claim 10 wherein the connector means is mounted on a carrier supported by the support means for movement between the connector means first and second positions.

12. The liquid dispenser assembly as defined in claim 11 wherein the carrier is pivotally mounted on the support means.

13. The liquid dispenser assembly as defined in claim 10 wherein the connector means includes a stopper pivotally mounted on the carrier means.

14. The liquid dispenser assembly as defined in claim 11 wherein the connector means includes a stopper pivotally mounted on the carrier means.

15. The liquid dispenser assembly as defined in claim 13 wherein the port is adapted to be engaged by the stopper of the connector means.

16. The liquid dispenser assembly as defined in claim 9 wherein the stop valve includes a seal portion which is push-fit with the port such that in the first position the seal portion is in engagement with an inside wall of the port, and in the second position the seal portion is pushed out of engagement with the port and into the pouch.

17. The liquid dispenser assembly as defined in claim 16 wherein the stop valve includes a vent portion which extends outwardly from said seal portion in which in the second position the vent portion remains in the port and facilitates the delivery of the liquid from the pouch.

18. The liquid dispenser assembly as defined in claim 17 wherein the vent portion is cruciform in cross-section.

19. The liquid dispenser assembly as defined in claim 17 wherein the elongate portion is cruciform in cross-section.

20. The liquid dispenser assembly as defined in claim 18 wherein the elongate portion is cruciform in cross-section.

21. The liquid dispenser assembly as defined in claim 9 wherein the flexible material is a plastic material.

22. The liquid dispenser assembly as defined in claim 9 wherein the port has a flange which is provided with a handle by which the pouch may be carried.

23. A liquid dispenser comprising an actuator, support means for supporting a collapsible container, connector means for connecting the collapsible container to the actuator when the collapsible container is supported by the support means, the connector means being mounted for movement between a first position spaced apart from the support means and a second position in which the connector means connects with the collapsible container when the connector means is supported by the support means thereby facilitating the supply of liquid from the collapsible container to the dispenser for delivery upon operation of the actuator, the connector means being mounted on a carrier supported by the support means for movement of the connector means between the connector means first and second positions, the carrier being pivotally mounted on the support means, and the connector means includes a stopper pivotally mounted on the carrier means.

* * * * *